United States Patent [19]

Royal

[11] 4,006,670

[45] Feb. 8, 1977

[54] METHOD AND APPARATUS FOR FORMING A COLLAPSED BOX

[75] Inventor: Thomas B. Royal, Homestead, Fla.

[73] Assignee: International Paper Company, New York, N.Y.

[22] Filed: Dec. 20, 1974

[21] Appl. No.: 534,710

[52] U.S. Cl. ..... 93/53 M; 93/49 M; 93/51 R; 93/53 R

[51] Int. Cl.[2] ..... B31B 5/00

[58] Field of Search ..... 93/36.3, 36 MM, 36 R, 93/53 R, 53 M, 49 R, 49 M, 51 H, 51 W, 51 R, 52; 53/387

[56] References Cited

UNITED STATES PATENTS

| | | | |
|---|---|---|---|
| 2,138,766 | 11/1938 | MacDonald | 93/53 R |
| 2,249,859 | 7/1941 | Shearer | 93/49 M |
| 2,279,534 | 4/1942 | Sidebotham et al. | 93/49 M |
| 3,039,670 | 6/1962 | Hardon | 229/27 |
| 3,309,970 | 3/1967 | Pierce | 93/53 M |
| 3,383,990 | 5/1968 | Cheu et al. | 93/49 R |
| 3,512,459 | 5/1970 | DiFrank | 93/49 R X |
| 3,635,129 | 1/1972 | Cobelo, Jr. | 93/51 R |
| 3,673,928 | 7/1972 | Striplin | 93/36.3 |

*Primary Examiner*—James F. Coan
*Attorney, Agent, or Firm*—Alfred L. Michaelsen

[57] ABSTRACT

A method and apparatus of forming a box from a substantially flat blank and subsequently collapsing the box.

26 Claims, 14 Drawing Figures

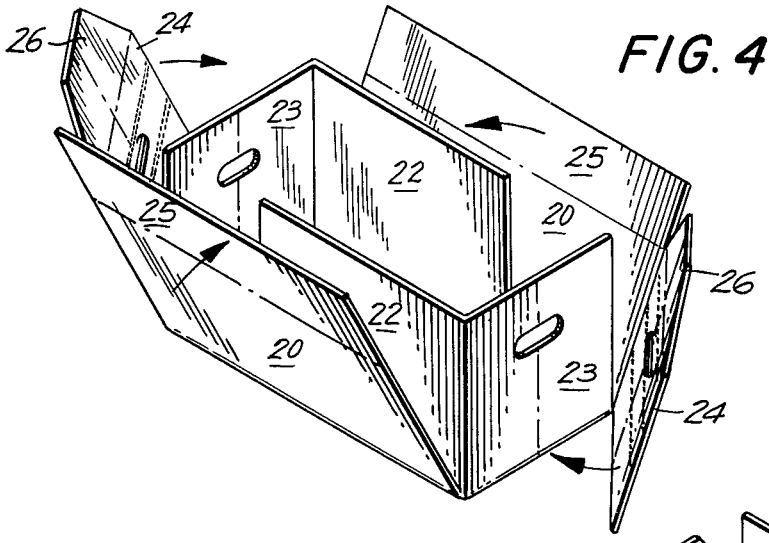
FIG. 4
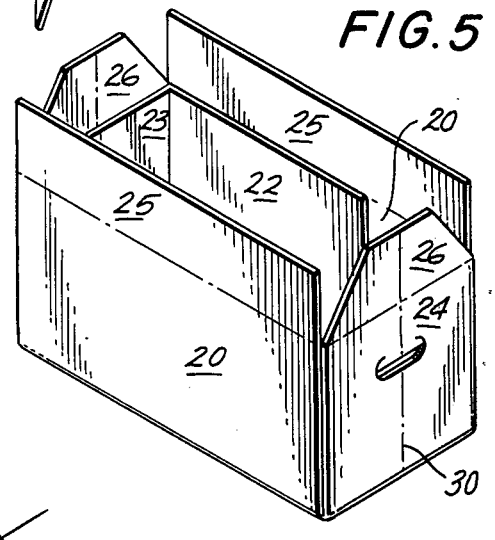
FIG. 5
FIG. 6
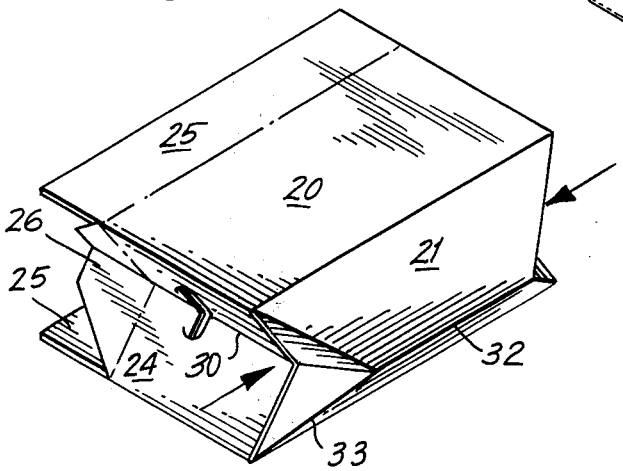
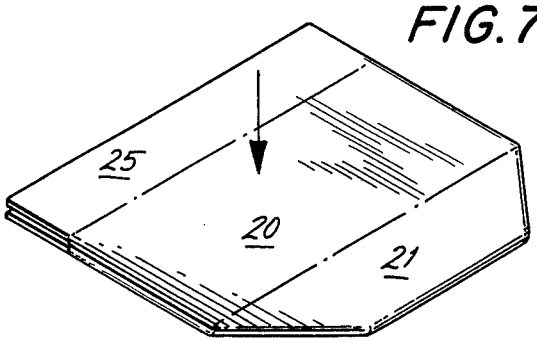
FIG. 7

METHOD AND APPARATUS FOR FORMING A COLLAPSED BOX

BACKGROUND OF THE INVENTION

1. Field to Which the Invention Pertains

This invention pertains to the box forming art and more particularly to the art of forming a box from a flat blank which has been appropriately cut and scored.

Paperboard boxes and particularly corrugated paperboard boxes are generally formed from a flat blank which has been appropriately cut and scored so as to facilitate the formation of a box. Because users of corrugated paperboard boxes may consume thousands of boxes daily, machines have been developed which will accept a flat paperboard blank and automatically form such a blank into an open box which is then discharged from the machine.

Although a wide variety of such machines have heretofore been developed, a particularly difficult problem is presented when it is required to automatically form a box having walls of more than a single thickness. More specifically, in the formation of such a box there will rise the requirement that large parts or flaps of the blank will have to be folded in such a manner that they are superimposed adjacent to other, equally large flaps or panels. The problem that is presented is distinct from the problem of folding a blank to form a box wherein the overlapping parts of the resulting box are relatively small. In the latter situation, it is relatively straight forward to secure the desired folding action since the parts of the blank to be folded into overlapping relation are relatively small and therefore multiple folding steps can be performed during a single motion of the blank. For example, if the parts of a blank which are to be folded into overlapping relation are relatively small, such parts may easily be folded while other major sections of the blank are also being folded. However, when it is required to form a box having large overlapping portions, the shear size of the overlapping portions may cause interference problems when the folding steps are performed.

Another problem which has faced the box forming art is the difficulty of forming a large box and then transforming the shape of the formed box so as to obtain a configuraton which will allow dense packing of the formed box whereby a plurality of formed boxes may be transported at a low cost. Once again, the box forming art discloses machines for collapsing previously formed boxes provided that such boxes are relatively small or are constructed of relatively lightweight materials such as folding carton paperboard.

The instant invention supplies a solution to these problems in that, in accordance with this invention, a corrugated paperboard blank of substantial size may be automatically formed into a box wherein at least one pair of walls have a double thickness. Further, the practice of this invention permits the automatic formation of such a box followed by the automatic collapsing thereof.

Thus, this invention pertains to a method and apparatus whereby a flat blank may be formed into a box wherein at least two walls of the box have a double thickness and whereupon the formed box may then be collapsed.

2. Prior Art

Relevant prior art U.S. Pat. Nos. are 2,249,859, 2,138,766, 2,279,534, 3,309,970 and 2,248,535. These patents appear to reflect the state of the art to which this invention pertains. Further, these patents suggest that the methods and apparatus disclosed therein have limited utility and that they are generally applicable only to blanks for forming relatively small boxes or blanks constructed of relatively lightweight and flexible paperboard such as folding carton paperboard. For example, the method and apparatus disclosed in U.S. Pat. No. 2,138,766 to MacDonald is said to be useful in connection with the collapsing of "Brightwood" boxes which, as those skilled in the art are aware, are open-top trays generally made of lightweight paperboard.

Similarly, it will be seen that in U.S. Pat. No. 2,279,534 there is disclosed a method and machine for making and collapsing paperboard boxes in the form of a shallow, open-top tray.

U.S. Pat. No. 3,309,970 discloses a method and apparatus for flat-folding bottom sealed cartons. However, as may be seen upon a review of this patent, the size of the apparatus disclosed therein is substantial and in order to secure the desired result a plurality of serially acting mechanisms are required, e.g. link-driven, folding mechanisms and a plurality of conveyor belts.

SUMMARY OF THE INVENTION

An apparatus which forms a flat blank into a box. The apparatus is preferably used to form a box from a blank having a bottom panel, side panels connected to the bottom panel, end flaps connected to the side panels and side flaps connected to the end panels. When operated, the machine functions to fold the side flaps and end panels against a box forming mandrel. The box forming mandrel is reciprocably mounted in the machine and, when driven downwardly, pushes the blank through a box forming cavity which folds the side panels and end flaps.

Preferably, the machine includes a blank storage hopper and means for feeding blanks, one at a time, from the blank storage hopper to the forming section of the machine. Preferably, when each blank is fed an adhesive is automatically deposited upon the interior side of the side panels and the end flaps. After the end panels and the side flaps have been folded and after the box has been pushed downwardly so as to fold the side panels and the end flaps, the end flaps are squeezed against the end panels and held until an adhesive bond is attained.

After the box has been formed it is transported from the box forming section of the machine to the collapsing section of the machine wherein the box is longitudinally impacted and then transversely compressed. Thereafter, the formed and collapsed box may automatically be discharged from the machine.

DESCRIPTION OF THE DRAWINGS

FIGS. 2–7 are isolated perspective views showing the steps which comprise the practice of this invention.

DESCRIPTION OF PREFERRED EMBODIMENT

Figure 1:
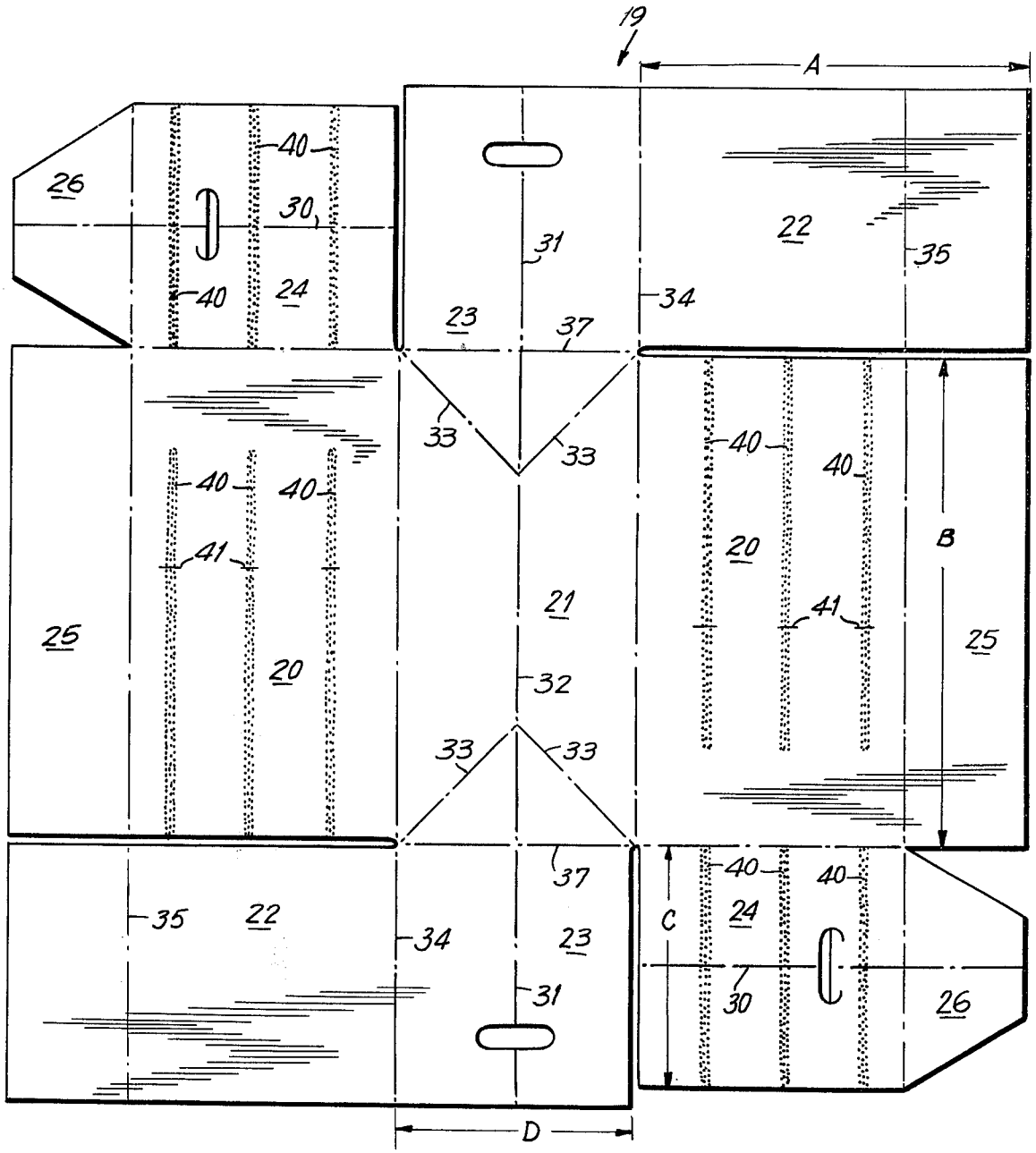
FIG. 1 is a plan view of a paperboard blank which may be automatically formed into an open box top by the practice of this invention.
Figure 2:
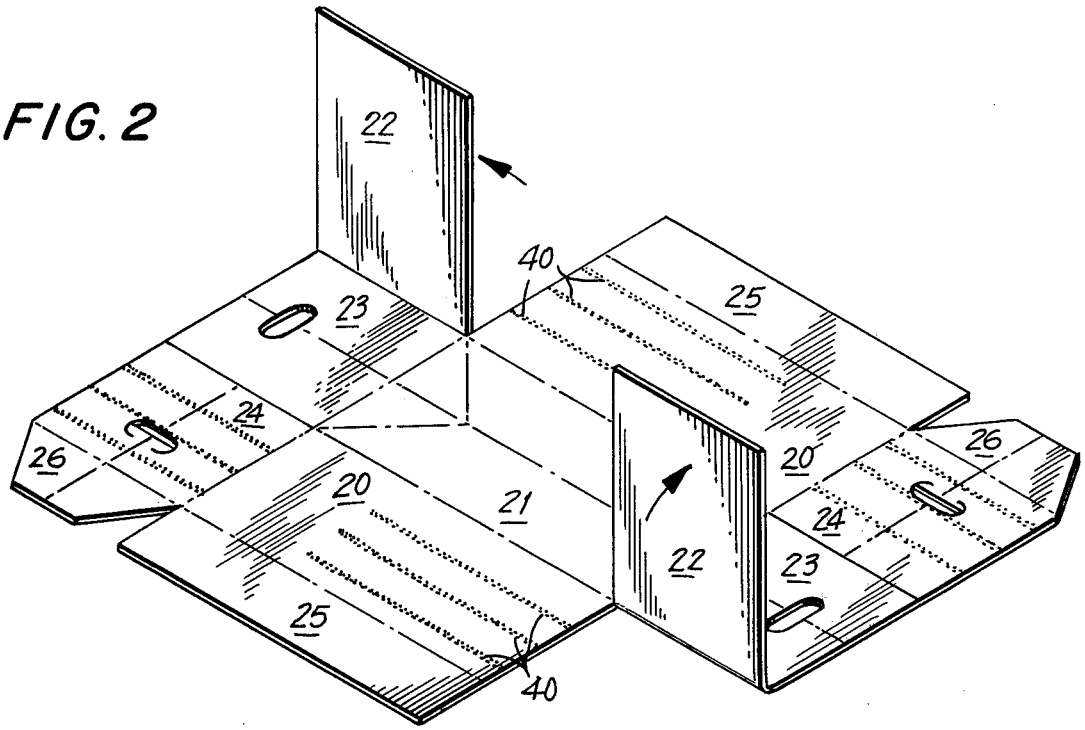

FIG. 1 shows, in plan view, a paperboard blank 19 of the type which may be manipulated in accordance with this invention in order to form an erected and collapsed box. The blank 19 is preferably constructed of corrugated paperboard.

Considering FIG. 1 in detail, the blank 19 is comprised of a bottom panel 21, side panels 20 foldably connected to opposite sides of the bottom panel 21 and end panels 23 foldably connected to end edges of the bottom panel 21. Additionally, there are provided side flaps 22, each of which is connected to a respective one of the end panels 23 and end flaps 24, each of which is connected to a respective one of said side panels 20. The blank 19 may advantageously be provided with top closing flaps 25 and 26. Also, the blank 19 is appropriately scored to promote collapsing when manipulated by an apparatus embodying this invention. Specifically, the end flaps 24 are provided with transverse score lines 30 located at the longitudinal center of the end flaps 24. Similarly, end panels 23 include longitudinal score lines 31 at the transverse center of the panels 23. The bottom panel 21 is longitudinally scored as at 32 and diagonally scored by the score lines 33. The purpose and effect of providing the score lines hereinbefore designated will be apparent from the following description of the operation of an apparatus embodying this invention.

Before the blank 19 of FIG. 1 is formed into a box, an adhesive pattern is preferably deposited on the interior surface of the blank as shown in FIG. 1. Thus, the blank 19 of FIG. 1 includes an adhesive pattern 40 on the end flaps 24 and the side panels 20. Preferably, the adhesive employed is a hot melt. The length of the adhesive pattern 40 on the side panels 20 is determined by the length of the side flaps 22. In this connection, however, it should be noted that the side flaps 22 may each be provided with a longitudinal score line 35. If the score line 35 is provided, then the adhesive pattern 40 on the side panels 20 is of a length equal to the distance between the score lines 34 and 35, e.g. the adhesive pattern 40 on the side panels 20 may terminate as indicated at 41. If this configuration is employed, the terminal portion of the side flaps 22, i.e. the portion of the side flaps extending transversely beyond the score line 35, may be folded inwardly into the box so as to form a dividing partition.

Figure 3:
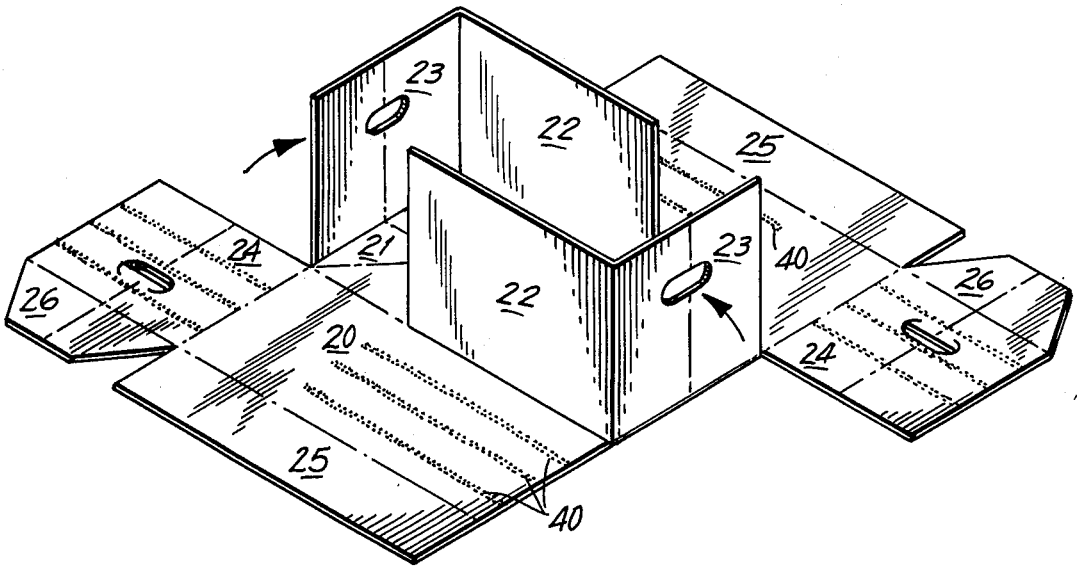

Referring to FIGS. 2–7, there are shown isolated, perspective views of the blank 19 as it would be folded in accordance with the preferred embodiment of this invention. Thus, referring to FIG. 2, the first step in the practice of my method is to fold the side flaps 22 so that they are perpendicularly disposed with respect to the end panels 23. Next, as shown in FIG. 3, the end panels 23 are folded 90° so that the end panels 23 are perpendicular to the bottom panel 21.

As shown in FIG. 4, the side panels 20 and the side flaps 22 are simultaneously folded. The folding action suggested by the arrows in FIG. 4 is continued until the configuration shown in FIG. 5 is secured. As may be noted in FIG. 5, the box 19′ is shown in its upright condition, i.e. resting on the bottom panel 21. In accordance with the preferred embodiment of my invention, the box 19′ is then turned 90° so as to rest on one of the side panels 20. When the box is so disposed, the box is longitudinally impacted along the fold lines 30 as suggested by the arrows in FIG. 6. As a result of this longitudinal impacting action the end walls of the box, which are comprised of the end flaps 24 and the end panels 23, collapse inwardly and the bottom panel 21 collapses outwardly as suggested by FIG. 6. Thereafter, as suggested by the arrow in FIG. 7, the box is vertically or transversely compressed by applying a compressive force over the surface of the side panels 20 which results in a total collapse of the box. Thus, it will be seen that in accordance with the preferred embodiment of the method of my invention, the blank 19 of FIG. 1 may be efficiently erected to form an open-top box and, thereafter, collapsed into a flattened condition.

Figure 8:
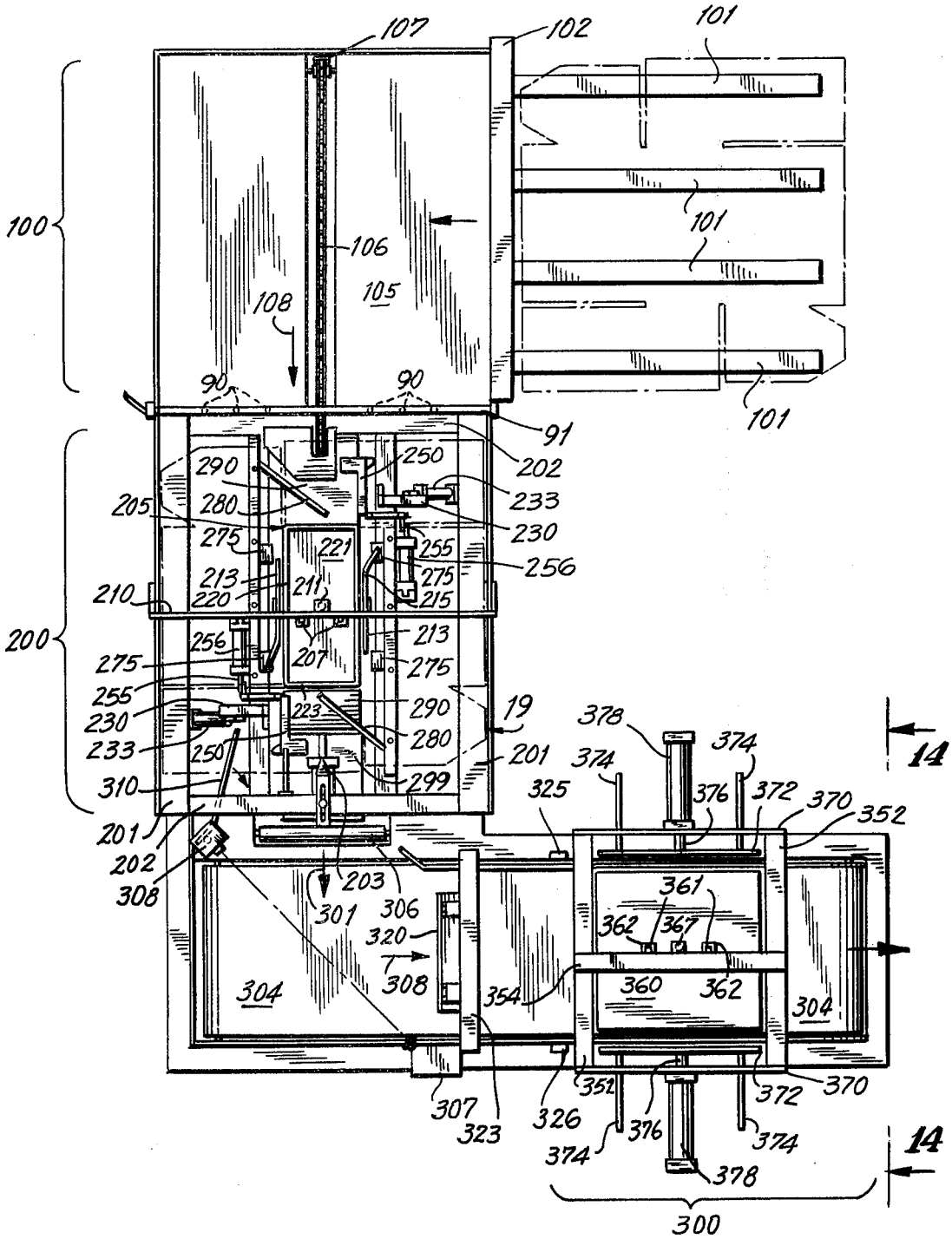
FIG. 8 is a plan view of a preferred apparatus embodying this invention.

Referring to FIG. 8, there is shown a plan view of a machine incorporating the preferred embodiment of my invention. In general terms, the machine in FIG. 8 includes a blank storage and feeding section 100, a box forming section 200 and a box collapsing section 300.

Considering the blank storage section 100, conventional blank storage and feeding means may be employed. However, I have found it preferable to employ a construction wherein a guantity of blanks are stacked on top of a number of horizontally disposed and vertically movable arms 101. The arms may be rigidly secured to a common cross member 102 which is vertically movable by a chain drive (not shown). In operation, the uppermost blank on the stack resting on the arms 101 is lifted off the stack by suction cups or other equivalent devices and fed between rotating feed rollers which advance the blank into the blank feeding section 105. As each blank is lifted off the stack and fed to the blank feeding section 105, the chain drive may be actuated so as to index upwardly the stack of blanks by one step, thereby assuring that the uppermost blank remains in a position close to whatever device is used to feed the blanks from the stack to the blank feeding section.

When the blank is received in the blank feeding section 105, it is disposed above a chain drive 106. Mounted on the chain drive 106 is a lug 107. Thus, when the chain drive is actuated, the lug 107 engages the trailing edge of the blank and feeds the blank in the direction of the arrow 108, i.e. the blank is fed from the blank storage and feeding section 100 into the box forming section 200.

Located between the blank feeding and storage section 100 and the box forming section 200 are a plurality of adhesive depositing guns 90. Depending downwardly from the cross member 91 upon which the adhesive guns 90 are mounted, is the arm of a microswitch which is tripped when a blank passes thereunder. In response, the adhesive depositing guns 90 are actuated and deposit adhesive on the end flaps and side panels of the blank. More specifically, using conventional timing mechanisms, the glue guns are actuated to deposit an adhesive pattern as shown in FIG. 1. Those skilled in the art will appreciate that there are a variety of devices available for detecting the passage of a blank below the cross member 91 and appropriately actuating the glue guns 90, for example lever operated microswitches or photocells.

The box forming section 200 includes horizontally disposed frame members 201 and 202. Preferably, the frame members 201 and 202 are L-shaped members in order that they also function to support a blank in a substantially horizontal plane, e.g. the blank 19 shown in phantom in FIG. 8. To insure that the blank is accurately, longitudinally positioned when it is fed from the blank storage section 100, a stop member 203, mounted on the cross member 202, may be provided.

Figure 9:
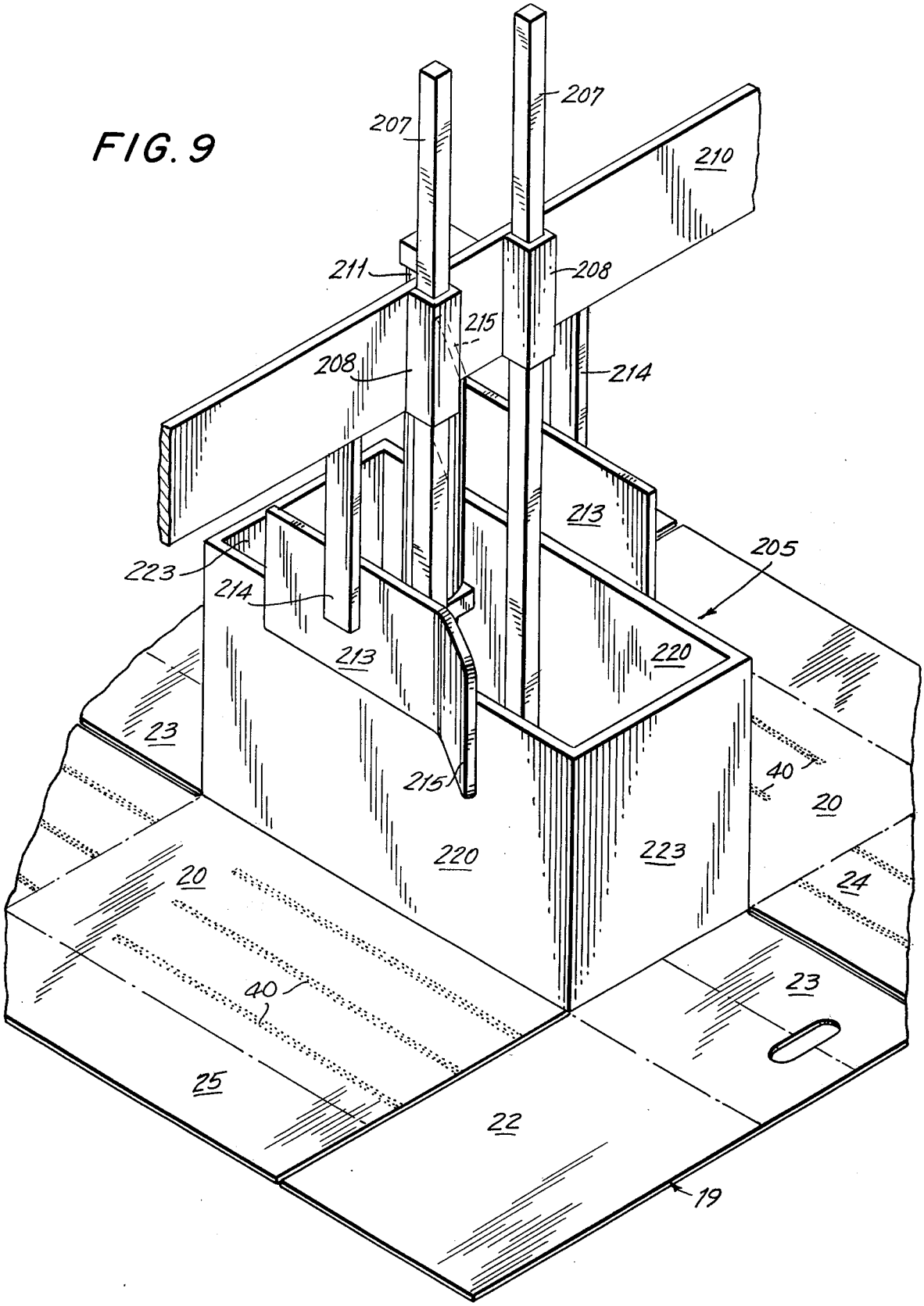
FIG. 9 is a perspective view of a sub-assembly of the machine shown in FIG. 8.

Referring to FIGS. 8 and 9, it will be seen that when the blank 19 is appropriately positioned within the box forming section 200, it will be disposed beneath a vertically and reciprocably mounted mandrel 205. The mandrel 205 has transverse faces 223, longitudinal or side faces 220 and a bottom face 221. Extending upwardly from the bottom face 221 are two guide bars 207. The guide bars 207 are slidably received in guide blocks 208 which are fixedly secured to the cross machine member 210. To provide reciprocating movement of the mandrel 205, a cylinder 211 is fixedly secured to the cross member 210. Extending downwardly from the cylinder 211 is a piston, the free end of which is secured to the bottom plate 221 of the mandrel 205.

A pair of guide shoes 213 are stationarily disposed adjacent to the sides 220 of the mandrel 205. The guide shoes 213 are mounted by brackets 214 which are secured, at one end, to the shoes 213 and, at the other end, to the cross member 210. Preferably, the brackets 213 are provided with outwardly extending, oppositely directed faces 215. FIG. 9 represents the position of the blank and the mandrel prior to beginning the forming sequence of my invention.

Figure 10:
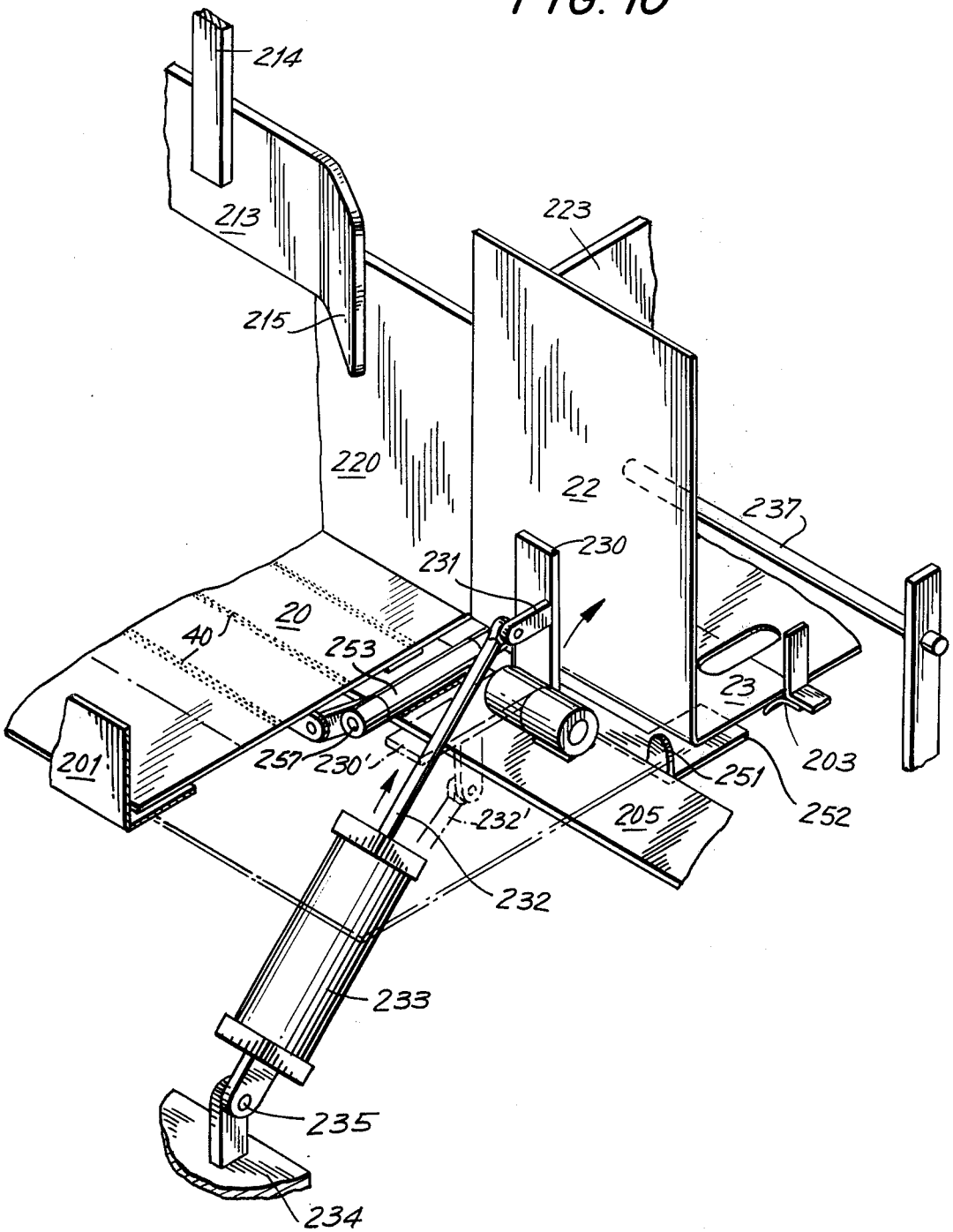
FIG. 10 is a fragmentary perspective view illustrating the operation of one component of the machine shown in FIG. 8.

Referring to FIG. 10, the first step in the forming sequence of my invention is shown as well as the apparatus elements associated therewith. Thus, as previously indicated, the first step in my folding sequence is to fold each of the side flaps 22 perpendicular to the end panels 23 to which they are respectively, foldably secured. To accomplish this step, side flap folding means in the form of folding arms 230 are rotatably mounted on respective frame members 205. As may best be seen in FIG. 8, a side flap folding arm 230 is provided at diagonally opposite corners of the mandrel 221. Referring again to FIG. 10 wherein, for clarity, only one of the side flap folding arm is shown, it will be seen that the side flap folding arm shown therein is provided with an extension arm 231. The free end of a piston 232 is pinned to the free end of the arm 231. The piston 232 is operatively received in double acting cylinder 233. The cylinder 233 is pinned to a frame member 234 as shown at 235. As suggested by the phantom lines in FIG. 10, when the piston 232 is in its retracted position (see 232') the folding arm 230 is disposed in a horizontal plane beneath the side flap 22 as shown by the phantom representation 230'. When the cylinder 233 is actuated, the piston 232 is extended thus rotating the folding arm 230 90° and thereby folding the side flap 22 perpendicular to the end panel 23. To insure that each of the side flaps 22 are not folded passed a vertical plane, folding stop bars 237 may be provided. For clarity, only one folding stop bar 237 is shown in FIGS. 8 and 10, however, it will be understood that although only one such bar is shown, an identically constructed bar will be similarly located diagonally opposite to the bar 237 as shown in FIG. 8.

Figure 11:
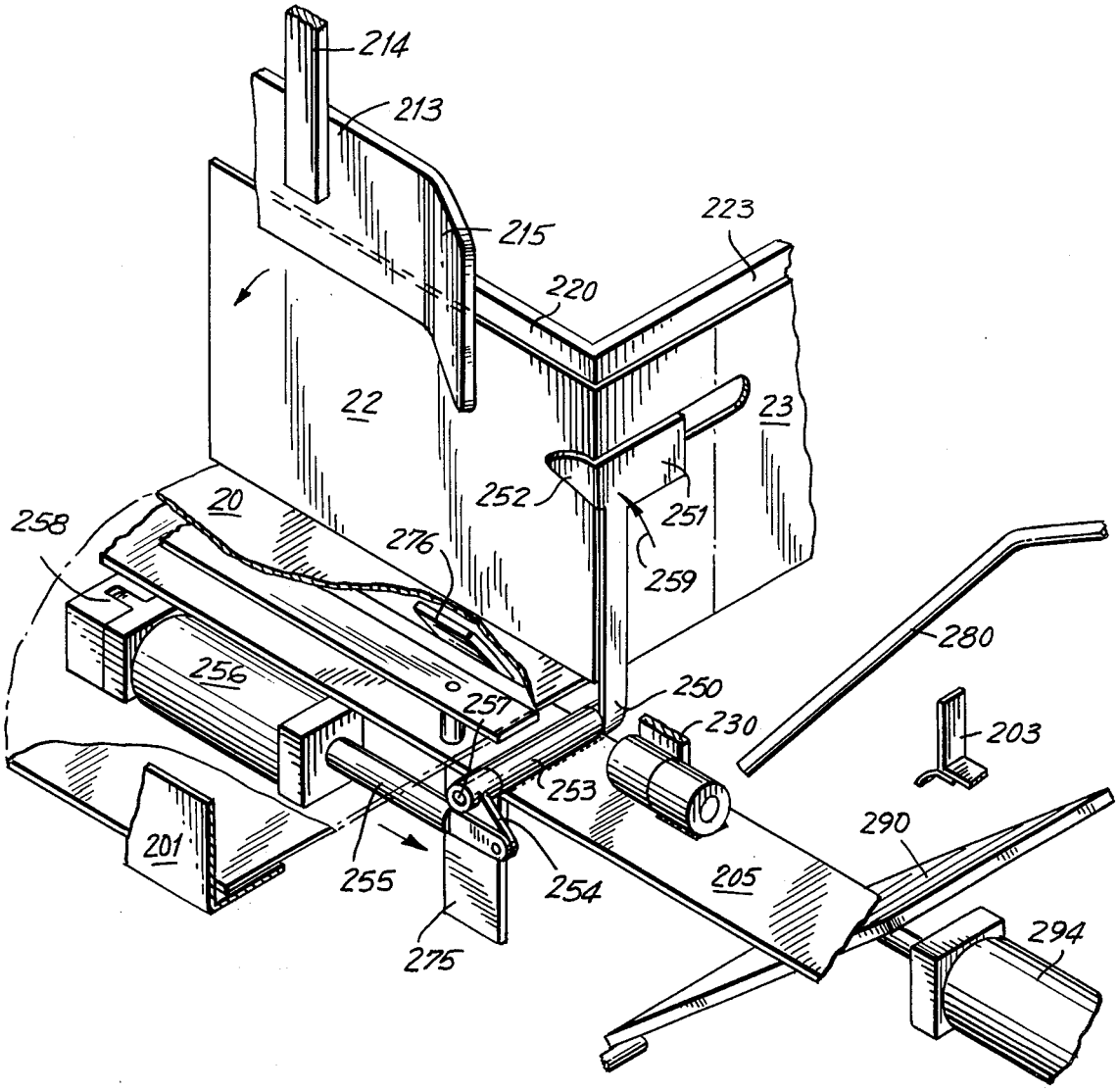
FIG. 11 is a fragmentary perspective view showing the operation of another component of the machine shown in FIG. 8.

After the side flaps 22 have been perpendicularly folded as shown in FIG. 10, the next step in the practice of my method is to fold the end panels 23 to a position perpendicular to the bottom panel 21. Referring to FIG. 11, there is shown the apparatus elements which are preferably employed to fold one of the end flaps, i.e. for clarity only one of the end flap folding means is shown in FIG. 11 although it is to be understood that a corresponding sub-assembly is diagonally, oppositely provided as may be seen in FIG. 8. Referring to FIGS. 8 and 11, an end panel folding means in the form of a folding arm 250 is provided. The folding arm 250 is rotatably mounted on the longitudinal frame member 205. Preferably, the folding arm 250 is mounted by providing a horizontally extending shaft 257 which is received in the journal bearing 253. The journal bearing 253 is fixedly secured to the longitudinal frame member 205. Secured to the end of the shaft 257 is a bushing having an arm 254. The free end of the arm 254 is pinned to a piston 255 which is operatively received in double acting cylinder 256. The cylinder 256 is secured to the frame of the machine as at 258. As may be seen in FIG 11, when the cylinder 256 is actuated, the piston 255 is moved to its extended position and, as a result, the folding arm 250 rotates 90°, as suggested by the arrow 259, and in this manner folds the end panel 23 to a position perpendicular to the bottom panel 21. Preferably, the end of the folding arm 250 is provided with perpendicularly disposed faces 251, 252. As may be seen in FIG. 10, when the cylinder 256 is reverse actuated so that the piston 255 is in its retracted position, the uppermost tip of the folding face 252 is below the plane of the end panel 23 and the interior of the folding face 252 is substantially aligned with the surface of the side panel 22 which is visible in FIG. 10. Preferably, the folding face 252 is curved outwardly so as to obviate the possibility of an interference when the folding arm 250 is actuated.

With further regard to the folding of the end panels 23, it will be appreciated that the folding arm 250 is actuated while the side flap folding arms 230 are in their actuated or vertical position. Thus, when the end panels 23 are perpendicularly folded, the side flaps 22 are rotated through 90° and within a vertical plane. To insure that the side flaps 22 are disposed adjacent to the side faces 220 of the mandrel after the end flaps 23 are folded, the previously mentioned guide shoes 213 are provided and preferably include the diagonally, outwardly extending faces 215. Thus, as the side flaps 22 are rotated through a vertical plane, it is insured that they are guided to a position adjacent to the side faces 220 of the mandrel.

Figure 12:
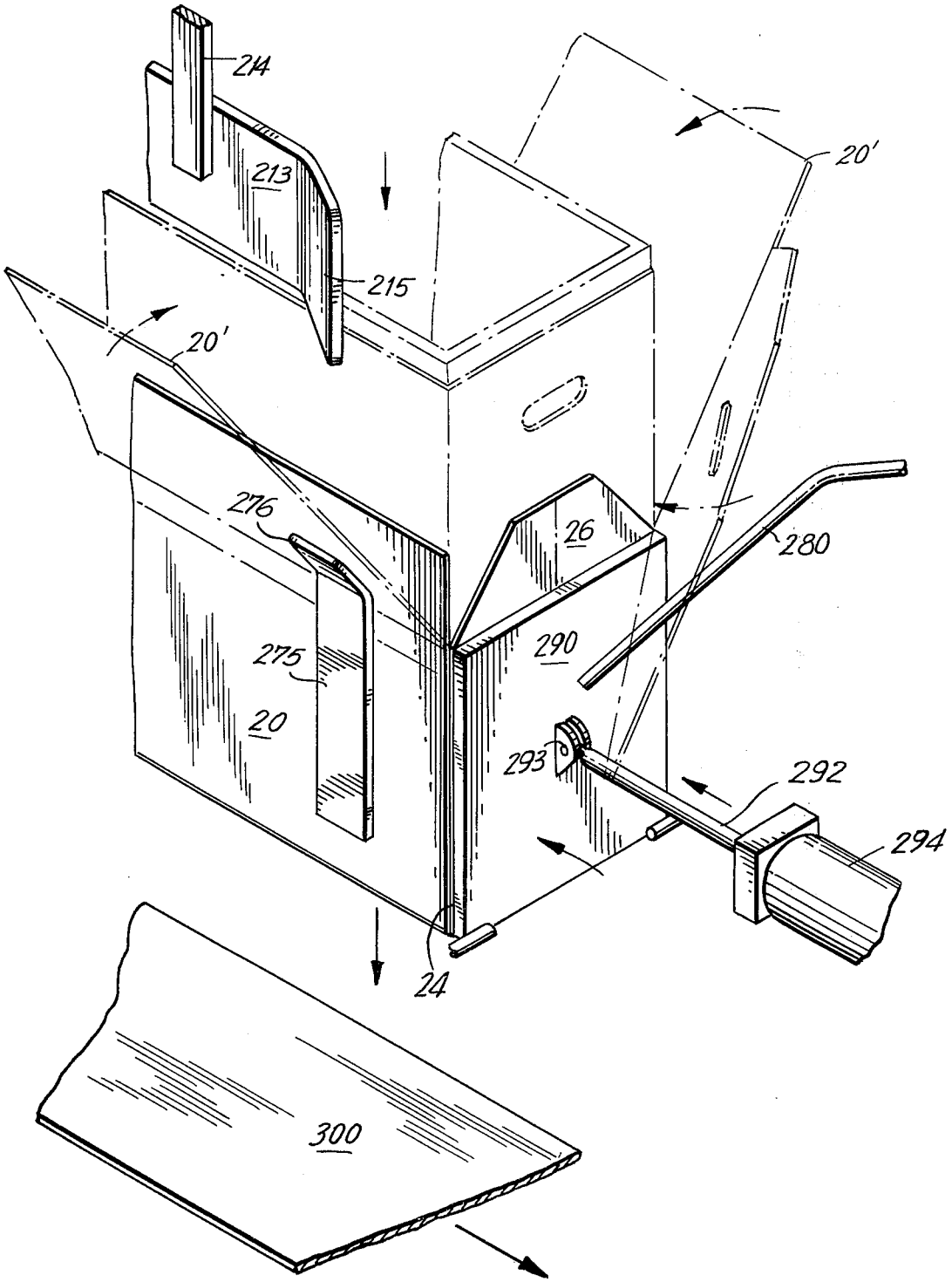
FIG. 12 is a fragmentary perspective view showing the interrelation and operation of certain other parts of the machine shown in FIG. 8.

At this point it should be noted that the side flaps 22 and the end panels 23 have been folded about the mandrel while the mandrel is stationary. The side panel and the end flaps are now folded about the mandrel as a result of downward movement of the mandrel. Thus, referring to FIGS. 9, 11 and 12, the cylinder 211 is actuated so as to drive the mandrel 205 downwardly which, in turn, pushes the blank 19 downwardly through a forming station or box forming cavity. As may be seen in FIGS. 8, a pair of side panel folding bars 275 are fixedly mounted on the frame of the machine on each side of the box forming station. In FIGS. 11 and 12, only one of the four side flap folding bars 275 is shown wherein it will be seen that this exemplary side panel folding bar includes an upwardly and outwardly extending face 276. Thus, as the blank 19 is driven downwardly by the mandrel, the side panels 20 are folded to a vertical position as they pass the side panel folding bars 275 and, initially, its upwardly and outwardly extending face 276. In FIG. 12, the side panels 20 are shown in phantom in their partially folded condition as at 20'.

As the blank 19 descends and side panels 20 are folded, the end panels 23 engage end panel folding means in the form of downwardly and inwardly extending folding bars 280, one of which is located at each longitudinal end of the box forming station. As may best be seen in FIG. 12, the end panel 23 shown therein is thus perpendicularly folded with respect to the side panel 20 as the blank 19 descends and as the side panel 20 is folded to the vertical.

At the end of the downward movement of the mandrel, the side panels and the end flaps will be positioned in substantially vertical and mutually perpendicular planes and the side panels will be disposed substantially perpendicular to the bottom panel 21. Since the side panel folding bars 275 are spaced apart a distance substantially equal to the outer dimension of the final box, it will be appreciated that as the mandrel descends the side panels will be urged against the previously folded side flaps and, as a result, an adhesive bond will be established between the side panels and the side flaps, i.e. the adhesive pattern 40 shown in FIG. 1 on the side panels 20 will provide an adhesive bond between the side panels and the side flaps.

At the end of the downward movement, there remains the step of squeezing together the end panels and the end flaps. Referring to FIG. 12, this step is accomplished by urging two squeezing plates 290 against the exterior surfaces of each of the end panels. In this manner, the end panels and the end flaps are compressed together between the squeezer plates 290 and the transverse faces of the mandrel 205. Preferably, the squeezer plates 290 are pivotly mounted and transversely disposed within the machine. To actuate the squeezer plates 290, there is associated with each of the plates a piston 292 which, at its free end, is pinned to a respective plate 290 as at 293. Each of the pistons 292 are operatively received in a respective, double acting cylinder 294. Thus, when the cylinders 294 are actuated, each squeezer 290 is moved into a position so as to squeeze together respective end panels and end flaps. When the cylinder 294 is reverse actuated, the squeezer plates 290 are positioned as suggested by the single squeezer plate 290 shown in FIG. 11. Again, for clarity, in FIGS. 11 and 12 only one squeezer plate has been shown, however, it will be apparent from an inspection of FIG. 8 that two such squeezer plates are provided.

When the squeezer plates 290 are actuated they are maintained in their actuated position for a time sufficient to allow the previously deposited adhesive on the end flaps 24 to form a secure bond. Thereupon, the squeezer plates 290 are retracted by reverse actuating the cylinders 294 and the mandrel 205 is retracted by reverse actuating the cylinder 211. Stripper plates (not shown) may be appropriately provided within the box forming station so as to strip the formed box from the mandrel when it retracts. Thereupon, the formed box may fall downwardly through the box forming station upon a continuously operated, longitudinally disposed conveyor belt 299 positioned beneath the box forming station.

The conveyor belt 299 is preferably, continuously running and provides a means for discharging a formed, erect container from the box forming section 200 of the machine.

Referring to FIG. 8, it will be seen that in accordance with the preferred embodiment of my invention, a formed box exits from the machine as indicated by the arrow 301 and is thereby delivered to a second conveyor belt 304 which is preferably, perpendicularly disposed with respect to the conveyor belt 299. To facilitate transfer of a formed carton from the conveyor 299 to the conveyor 304, a roller 306 may be provided. Additionally, a light source 307 and a photocell 308 may be provided as shown in FIG. 8 whereby the vertical leading edge of a formed carton may be detected when it is partially disposed on top of the conveyor 304. When a formed box is so positioned, the light from the source 307 will be interrupted and, when this condition is detected by the photocell 308, an arm 310 may be actuated to move in the direction suggested by the arrow associated therewith with the result that movement of the arm will displace the box completely onto conveyor 304. When the box is entirely disposed on the conveyor 304 it will be in an upright position, i.e. it will be resting on its bottom panel 21. The conveyor 304 is then actuated so as to move in the direction suggested by the arrow in FIG. 8.

Figure 13:
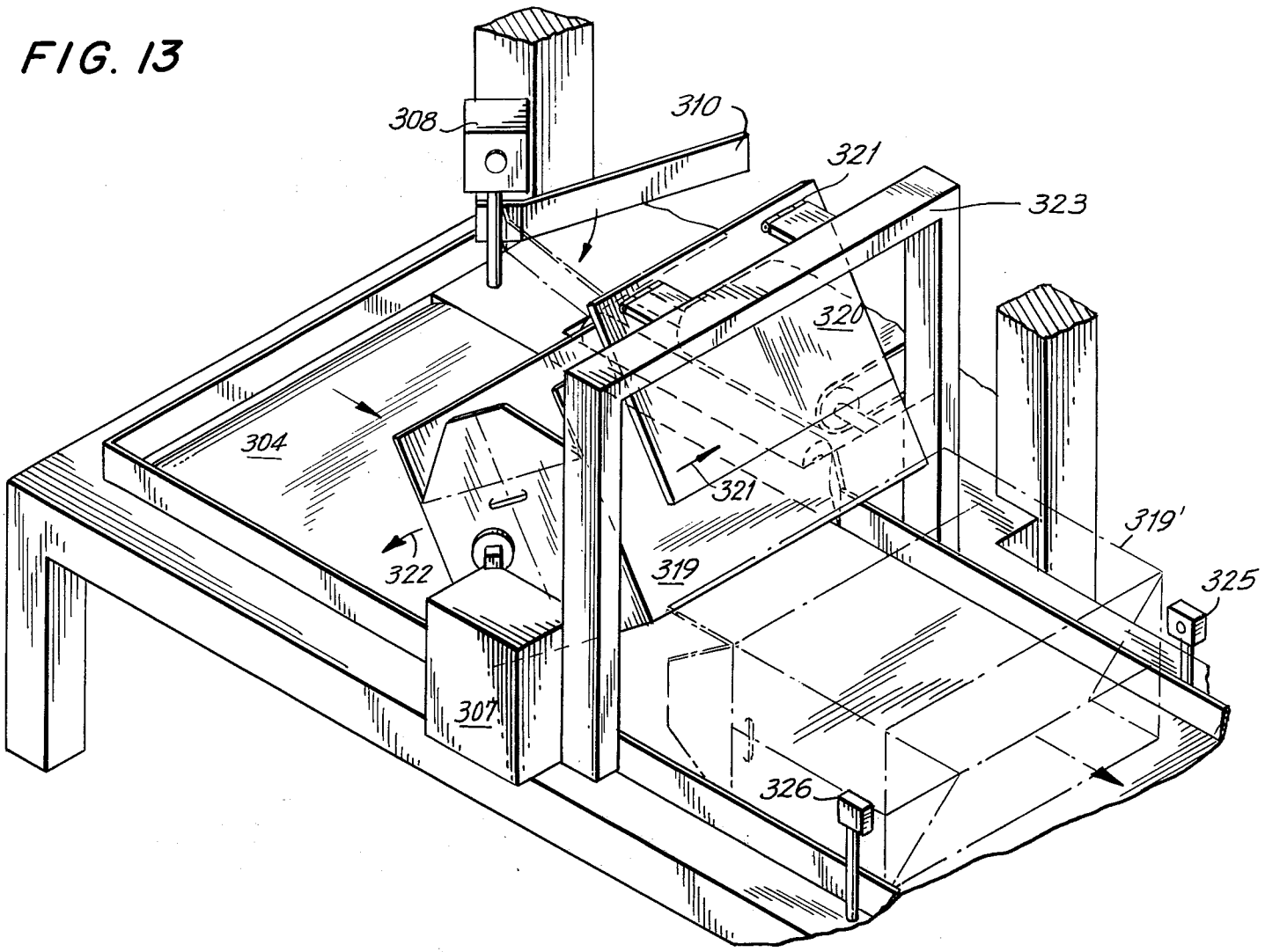
FIG. 13 is a fragmentary perspective view of one part of the machine shown in FIG. 8.

Referring now to FIG. 13 there is shown the mechanism employed in the preferred embodiment of my invention in order to turn a formed box 319 from its upright position to a position wherein the box is disposed on its side. More specifically, as shown in FIGS. 8 and 13, a plate 320 is hinged as at 321 to a cross member 323. Thus, when a box 319, moving on the conveyor belt 304, encounters the hingedly mounted plate, the plate 320 swings as suggested by the arrow 321 while the carton 319 is rotated as shown by the arrow 322. In this manner, as the box 319 passes by the suspended plate 320, it is rolled over so as to lie on one of its side panels. The phantom representation 319' in FIG. 13 suggests the position of the box 319 after it passes the suspended plate 320.

When a formed box reaches the position suggested by the phantom representation 319' in FIG. 13, the position of the box is detected by a light source photocell arrangement 325, 326. When the position of a formed box is thus detected, a signal is provided stopping movement of the conveyor belt 304. When movement of the box is thus stopped, the formed box, disposed on its side, is positioned within a collapsing station generally referred to by the reference number 300 in FIGS. 8 and 14.

Figure 14:
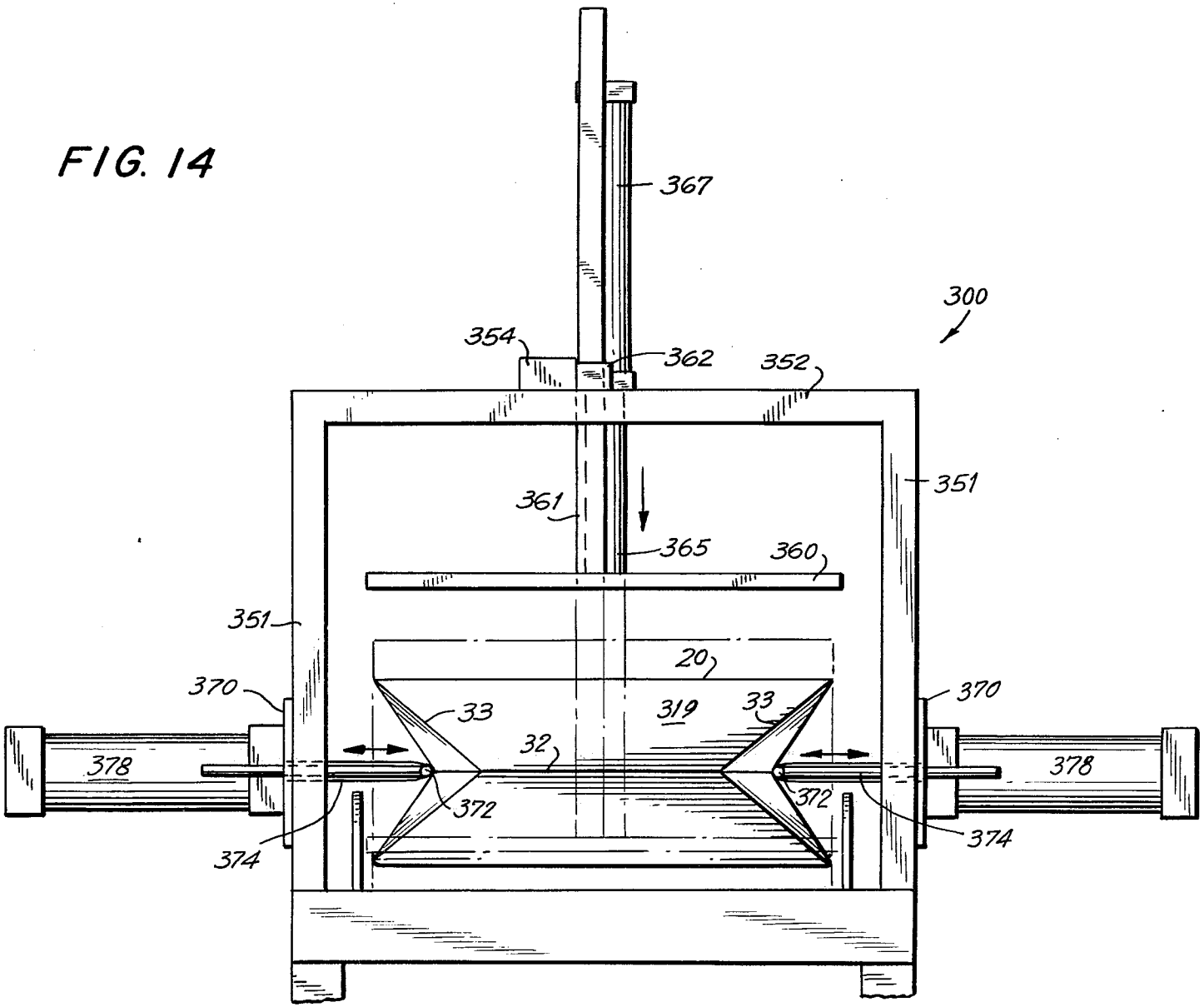
FIG. 14 is a side view of one part of the machine shown in FIG. 8.

The collapsing station 300 shown in FIGS. 8 and 14 includes a frame comprised of two pairs of upstanding support members 351 and a pair of cross members 352. A longitudinal cross member 354 is fixedly secured to the transverse cross members 352.

A horizontally disposed collapsing plate 360 is slidably mounted on longitudinal cross member 354 by a pair of vertically extending guide rods 361 which are slidably received in guide blocks 362 that are fixedly secured to longitudinal cross member 354. Also secured to the top of collapsing plate 360 is the free end of the piston 365 which is operatively received in double acting cylinder 367 that is fixedly secured to the longitudinal cross member 354.

A pair of longitudinally disposed plates 370 are secured to the vertical frame members 351. A pair of horizontally, longitudinally disposed impacting bars 372 are slidably mounted to the plates 370. More specifically, each of the impacting bars 372 is provided with a pair of outwardly extending guide rods 374 which are slidably received through appropriate mounting means on a respective plate 370. Additionally, secured to each of the impacting bars 372 is a respective piston 376 which extends outwardly and is received in a respective double acting cylinder 378 which is also secured to a plate 370.

When a formed box 319 is appropriately positioned within the collapsing station 300, which positioning is insured by the photocell/light source 325/326, the cylinders 378 are simultaneously actuated thereby driving the impacting bars 372 toward each other. As a result, the impacting bars transversely impact the stationary box 319 along the score lines 31 on the end panels 23. As a result, and because of the score line pattern provided on the box as shown in FIG. 1, the box 319 partially collapses. Almost immediately after the impacting step, the cylinders 378 are reverse actuated thus retracting the impacting bars 372. Thereafter, the cylinder 367 is actuated, thereby driving the collapsing plate downwardly and exerting a vertical force on the top of the box 319 as shown in FIG. 14, i.e. the side panels 20 of the box are compressed toward each other. The compressing action of the compressor plate 360 completes the collapsing of the box and thereupon the cylinder 367 is reverse actuated to retract the compressor plate 360. Upon retraction of the compressor plate 360, appropriate timing means reactivate the conveyor belt 304 and a formed, but collapsed box is discharged from the collapsing section 300.

Having described a preferred embodiment of my invention, those skilled in the art will appreciate that one advantage thereof is that it provides a method and apparatus whereby a box may be formed from a blank having side flaps wherein, when the box is formed, each side flap has a length which is at least, approximately, equal to half the length of the side panel associated therewith. Also, through the practice of my invention, a box may be automatically formed wherein the width of each end flap is at least, approximately, equal to half the width of each end panel and preferably each end flap is of approximately the same width as the end panel associated therewith. Stated otherwise, and referring to FIG. 1, the length A is at least, approximately, equal to half the length B and the length C is, approximately, at least equal to half the length of D and preferably, approximately, equal to the length D.

Although a detailed description of a preferred embodiment of my invention has hereinbefore been presented, those skilled in this art will readily perceive obvious modifications thereof which are nevertheless within the scope of the appended claims.

I claim:

1. The method of forming a box from a flat blank having a bottom panel, side panels connected to opposite sides of said bottom panel, end panels connected to opposite ends of said bottom panel, a pair of side flaps each connected to a respective one of said end panels, and a pair of end flaps each connected to a respective one of said side panels which comprises:

a. folding said side flaps and said end panels around a stationary mandrel;

b. moving said blank downwardly while folding said side panels and said end flaps; and c. squeezing together said end flaps and said end panels.

2. The method of forming a collapsed box from a flat blank having a bottom panel, side panels connected to opposite sides of said bottom panel, end panels connected to opposite ends of said bottom panel, a pair of side flaps each connected to a respective one of said panels, and a pair of end flaps each connected to a respective one of said side panels, which comprises:

a. folding said side flaps and said end panels around a stationary mandrel;

b. moving said blank downwardly while folding said side panels and said end flaps;

c. squeezing together said end flaps and said end panels;

d. removing the formed box from said mandrel;

e. longitudinally impacting said box; and f. transversely compressing said box.

3. The method of collapsing a formed box which comprises:

a. longitudinally impacting a stationary box; and b. transversely compressing said impacted and stationary box.

4. A box collapsing apparatus which comprises:

a. a frame;

b. means for positioning a box within said apparatus;

c. means reciprocably mounted on said frame for longitudinally impacting a positioned box; and d. means mounted on said frame for transversely compressing a box after it has been longitudinally impacted and while said box is stationary.

5. The apparatus of claim 4 wherein said impacting means comprises:

a. a pair of parallel, spaced apart, horizontally disposed bars reciprocably mounted on said frame; and b. means for driving said bars toward each other and away from each other.

6. The apparatus of claim 5 which further includes:

a. conveyor means for transporting a box into and out of said apparatus; and b. said compressing means comprises a horizontally disposed compressor plate reciprocably mounted on said frame, above said conveyor means and above said horizontally disposed bars; and c. means for reciprocating said compressor plate.

7. The apparatus of claim 6 which further comprises:

a. position detection means for providing an output when a box on said conveyor means is positioned in said apparatus for collapsing; and b. means for stopping said conveyor means in response to said signal.

8. An apparatus for forming a box from a flat blank having a bottom panel, side panels connected to opposite sides of said bottom panel, end panels connected to opposite ends of said bottom panel, a pair of side flaps each connected to a respective one of said end panels, and a pair of end flaps each connected to a respective one of said side panels, said apparatus comprising:

a. means for folding said side flaps to a position perpendicular to said end panels;

b. means for folding said end panels to a position perpendicular to said bottom panel;

c. means for folding said side panels to a position perpendicular to said bottom panel;

d. means for folding each of said end flaps to a position perpendicular to said side panels and in substantially face abutting relation to respective end panels; and e. means for squeezing together respective pairs of said end flaps and said end panels.

9. The apparatus of claim 8 wherein said end panel folding means are movable and fold said end panels while said bottom panel is stationary.

10. The apparatus of claim 9 wherein said side panel folding means are movable and fold said side panels while said bottom panel is stationary.

11. The apparatus of claim 10 which further comprises means for collapsing a formed box.

12. The apparatus of claim 11 wherein said box collapsing means includes:

a. means for impacting opposite walls of a box; and b. means for vertically compressing a box.

13. The apparatus of claim 12 which further includes:

a. a reciprocably mounted mandrel;

b. blank storage means; and c. means for feeding blanks, one at a time, from said blank storage means to a position below said mandrel.

14. A box forming apparatus which comprises:

a. a frame;

b. a mandrel reciprocably mounted on said frame;

c. means for positioning beneath said mandrel a flat blank having a bottom panel, side panels connected to opposite sides of said bottom panel, end panels connected to opposite ends of said bottom panel, a pair of side flaps each connected to a respective one of said end panels, and a pair of end flaps each connected to a respective one of said side panels;

d. means for positioning said side flaps and said end panels adjacent to said mandrel while said mandrel is stationary;

e. means for reciprocating said mandrel;

f. means for perpendicularly folding said end flaps and said side panels when said mandrel pushes said blank downwardly; and g. means for squeezing together respective pairs of said end panels and said end flaps.

15. The apparatus of claim 14 wherein said end panel folding means and said side flap folding means are movably mounted on said frame.

16. The apparatus of claim 15 which further comprises:

a. blank storage means;

b. means for feeding blanks, one at a time, from said blank storage means to a position below said mandrel; and c. means for depositing an adhesive on selected positions of a blank as it is fed from said blank storage means.

17. The apparatus of claim 16 which further includes means for collapsing a formed box.

18. An apparatus for forming a collapsed box from a flat blank, said apparatus comprising:

a. a box forming section comprising, i. a vertically reciprocable mandrel, ii. means for partially folding said blank around said mandrel when said mandrel is stationary, and iii. means for folding the remainder of said blank around said mandrel when said mandrel moves downwardly.

b. a box collapsing section comprising, i. means for longitudinally impacting a formed, stationary box, and ii. means for transversely compressing said box; and c. means for transferring a formed box from said box forming section to said collapsing section.

19. The apparatus of claim 18 which further includes means for positioning a formed box in said box collapsing section.

20. The apparatus of claim 19 wherein said transport means further includes means for turning an upright, formed box onto its side.

21. The apparatus of claim 20 wherein said transport means comprises:

a. first conveyor means longitudinally disposed below said box forming station; and b. second conveyor means positioned adjacent to the discharge end of said first conveyor means and transversely disposed with respect to said conveyor means.

22. The apparatus of claim 21 which further includes means for transferring a formed box from said first conveyor means to said second conveyor means.

23. An apparatus for forming a box from a flat blank having a bottom panel, side panels connected to opposite sides of said bottom panel, end panels connected to opposite ends of said bottom panel, a pair of side flaps each connected to a respective one of said end panels, and a pair of end flaps each connected to a respective one of said side panels, said apparatus comprising:

a. a frame;

b. means for supporting said blank in a flat condition;

c. a mandrel mounted on said frame for vertical, reciprocating movement;

d. means movably mounted on said frame for folding each of said side flaps perpendicular to said end panels;

e. means movably mounted on said frame for folding each of said end panels to a position perpendicular to said bottom panel and adjacent to said mandrel;

f. first and second side flap alignment means mounted on said frame and adjacent to said mandrel when said mandrel is at its uppermost position;

g. side panel and end flap folding means mounted on said frame below said support means;

h. means for reciprocating said mandrel; and i. means for actuating and driving said side flap folding means and said end panel folding means.

24. The apparatus of claim 23 wherein said alignment means, said side panel folding means and said end flap folding means are fixedly mounted on said frame.

25. The apparatus of claim 24 which further includes:

a. means for depositing adhesive on the interior surface of said end flaps and said sidepanels and b. means for squeezing together said end flaps and said end panels after said end flaps and said end panels have been folded.

26. The apparatus of claim 25 wherein said squeezing means comprises:

a. a pair of longitudinally spaced apart plates transversely and movably mounted on said frame; and b. means for actuating said plates when said mandrel is stationary and at its lowermost position.

* * * * *

UNITED STATES PATENT AND TRADEMARK OFFICE

CERTIFICATE OF CORRECTION

PATENT NO. : 4,006,670

DATED : February 8, 1977

INVENTOR(S) : Thomas B. Royal

It is certified that error appears in the above-identified patent and that said Letters Patent are hereby corrected as shown below:

Column 4, Line 33, "guantity" should be --quantity--;

and

Column 7, Line 48, after "squeezer" insert --plate--.

Signed and Sealed this

Third Day of May 1977

[SEAL]

*Attest:*

RUTH C. MASON
*Attesting Officer*

C. MARSHALL DANN
*Commissioner of Patents and Trademarks*